US005395267A

United States Patent [19]

Tregoning

[11] Patent Number: 5,395,267

[45] Date of Patent: Mar. 7, 1995

[54] ELECTRICAL CONNECTOR

[76] Inventor: William L. Tregoning, 60 Onset Ave., R.F.D. #3, Buzzards Bay, Mass. 02532-4904

[21] Appl. No.: 57,281

[22] Filed: May 5, 1993

[51] Int. Cl.[6] ..... H01R 13/648

[52] U.S. Cl. ..... 439/607; 439/89

[58] Field of Search ..... 439/88, 89, 607–610, 439/283

[56] References Cited

U.S. PATENT DOCUMENTS

| | | | |
|---|---|---|---|
| 3,288,958 | 11/1966 | Walter et al. | 439/607 |
| 3,458,852 | 7/1969 | Higgins, Jr. | 439/89 |
| 3,471,826 | 10/1969 | Hutter et al. | 439/283 |
| 4,090,767 | 5/1978 | Tregoning | 439/610 |
| 4,786,260 | 11/1988 | Spaulding | 439/607 |
| 4,886,463 | 12/1989 | Scott et al. | 439/89 |

*Primary Examiner*—Larry I. Schwartz

*Assistant Examiner*—Hien D. Vu

*Attorney, Agent, or Firm*—Nields & Lemack

[57] ABSTRACT

The invention relates to shielded cables and in particular to an electrically conductive junction between the conduit which shields the cable and the electrical connector at the end of the cable which serves as the cable termination. The invention comprehends an EMI/RFI adapter-ring pair each member of which surrounds the terminations of the plurality of central conductors within one of the cables to be connected and which is in electrical contact with the outer shield of the cable throughout its periphery. An annular projection on one member of the adapter-ring pair coacts with an annular cavity or groove on the other member, so that a tight fit results when the connector is pushed together. One or both sides of the cavity and projection may be of a sloping configuration.

4 Claims, 3 Drawing Sheets

ELECTRICAL CONNECTOR

BACKGROUND OF THE INVENTION

1. Field of the Invention

This invention relates to the field of electrical connectors.

2. Description of the Prior Art

Cable assemblies having multiple conductors frequently are provided with RFI (radio frequency interference) shielding or EMI (electromagnetic interference) shielding, and this shielding may be a braided conduit or a flexible metal conduit. Such cable assemblies frequently are also subject to EMC (electromagnetic compatability) requirements. A typical braided conduit is tin over copper, in which wires or thin filaments of tin over copper are braided to form the conduit. Another typical material is stainless steel. The electrical connector termination typically has a plurality of apertures to receive each wire in the cable assembly. Moreover, in order to make the connection between the individual wire and the aperture therefor, provision must be made which tends to occupy additional space, sometimes involving jumper connections. The electrical connector termination thus has an outside diameter which is substantially greater than that of the cable. These cables are useful in the aerospace commercial program and elsewhere.

A cable termination assembly with cast conductive shield and method of making same is disclosed and claimed in U.S. Pat. No. 4,090,767 to Tregoning. In accordance the disclosure of said patent, a conductive connection is directly molded onto the electrical connector and braided conduit shielding the cable assembly. As a simple connection the connector may be pretinned, the pertinent area may be surrounded wih an aluminum mold, and a solder comprising 60% tin and 40% lead may be poured therein. Alternate molding techniques include injection molding, etc. However, any conducting material or alloy may be used. The aforementioned conductive connection is hereinafter referred to as a "directly molded conductive connection".

SUMMARY OF THE INVENTION

The present invention comprehends an electrical connector having a homogeneous outer shell on the connector insert, which results in a 360 degree electromagnetic shield after the connectors are mated. This invention also serves as a backshell which has a dual purpose, as follows: (1) it provides a surface which continues the 360 degree electrical bond to the copper braided shield of the electrical cable; and (2) the design also incorporates a potting well which provides a strain relief to secure the electrical wires of the cable.

DETAILED DESCRIPTION OF THE INVENTION

Figure 2:
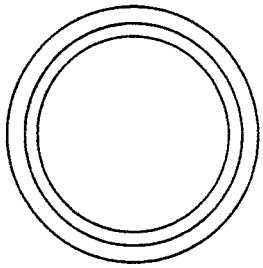
FIG. 2 is a side view along the line 2—2 of FIG. 1.
Figure 1:
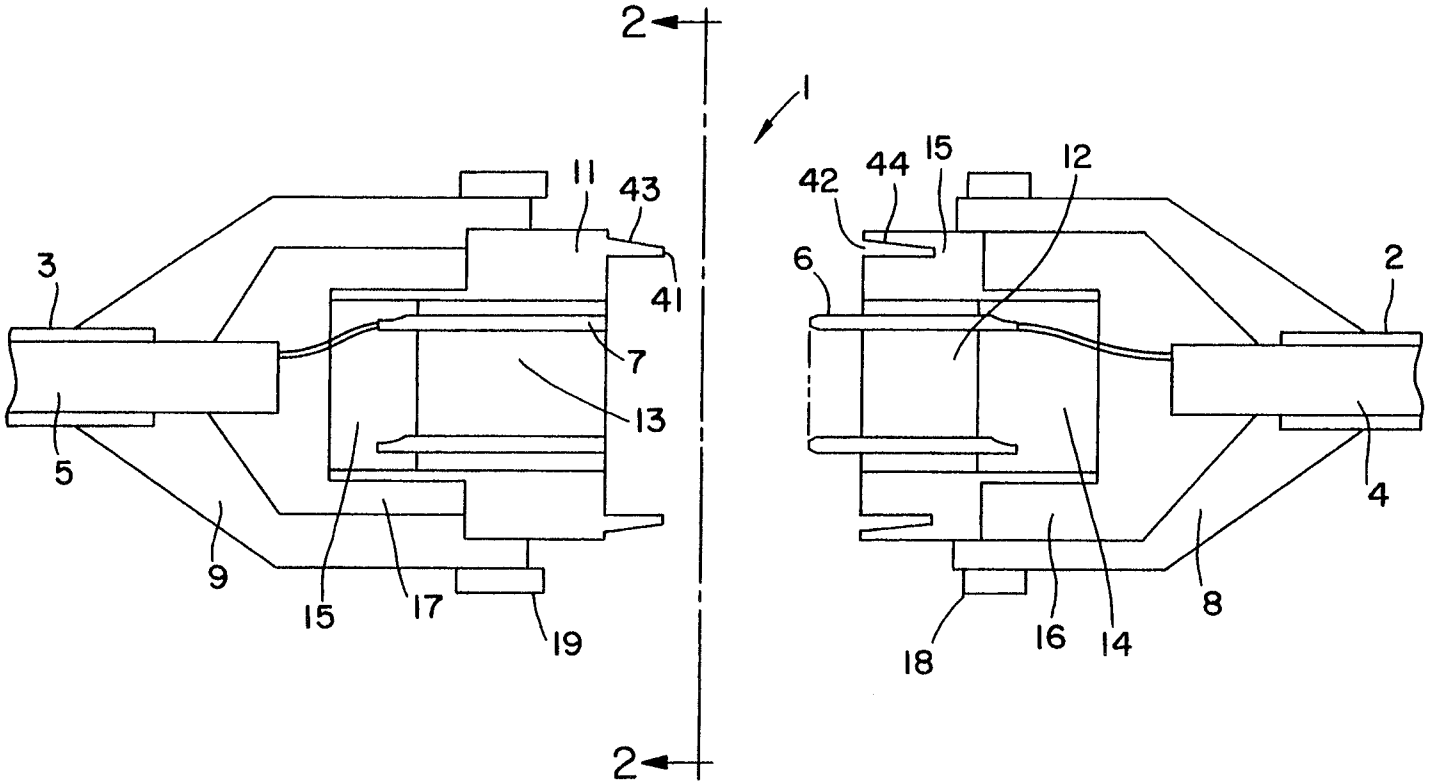
FIG. 1 is a central section of an electrical connector having a circular configuration and constructed in accordance with the invention.

Referring to the drawings, and first to FIGS. 1 and 2 thereof, the purpose of the electrical connector 1 therein shown is to connect one length of cable 2 to another length of cable 3. Each length of cable includes a plurality of central conductors surrounded by a copper braided shield 4, 5. The central conductors of one length of cable 2 are connected to a corresponding plurality of pins 6, and the central conductors of the other length of cable 3 are connected to a correponding plurality of sockets 7. An outer housing 8,9 of molding compound is supported upon the termination of each cable. An EMI/RFI adapter ring 10,11 is supported inside the outer housing so as to form a cavity at the termination of each cable. The pins are supported within one connector insert 12, and the sockets are created inside another connector insert 13, the connector inserts being supported within the adapter ring. An inner disk 14, 15 of molding compound is supported within each half of the adapter ring so as to form, with the outer housing of molding compound, a mold. As a final step in the construction of the connector, the two molds are filled with a directly molded conductive connection 16,17 made in accordance with the aforementioned U.S. Patent, so as to provide an electrical connection between the copper braided shield and the adapter ring and so as to provide a potting well which provides a strain relief to secure the electrical wires of the cable.

Outside the outer housing a coupling mechanism 18,19 is supported. The coupling mechanism may be formed integrally with the housing or affixed thereto. The coupling mechanism may comprehend a screw-on, a bayonet, a twist-on, a squeeze fit, or any other suitable mechanism.

The adapter ring includes an annular projection 41 on one half 11 thereof and an annular cavity 42 on the other half 10 thereof. The geometry of the projection corresponds to that of the cavity, and in the embodiment of the type shown in FIGS. 1 and 2 it may be annular with one or two-sloping edges, with the result that as the connector is pushed together a tight fit results. In the embodiment shown in FIGS. 1 and 2 there is one sloping edge; thus, the sloping edge 43 on the projection 41 presses against the sloping edge 44 in the cavity 42 as the connector is pushed together. Alternatively, or in addition, a spring may be provide on one or both edges.

Figure 4:
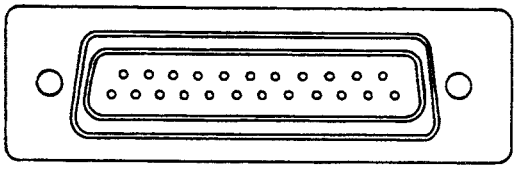
FIG. 4 is a side view along the line 4—4 of FIG. 3.
Figure 3:
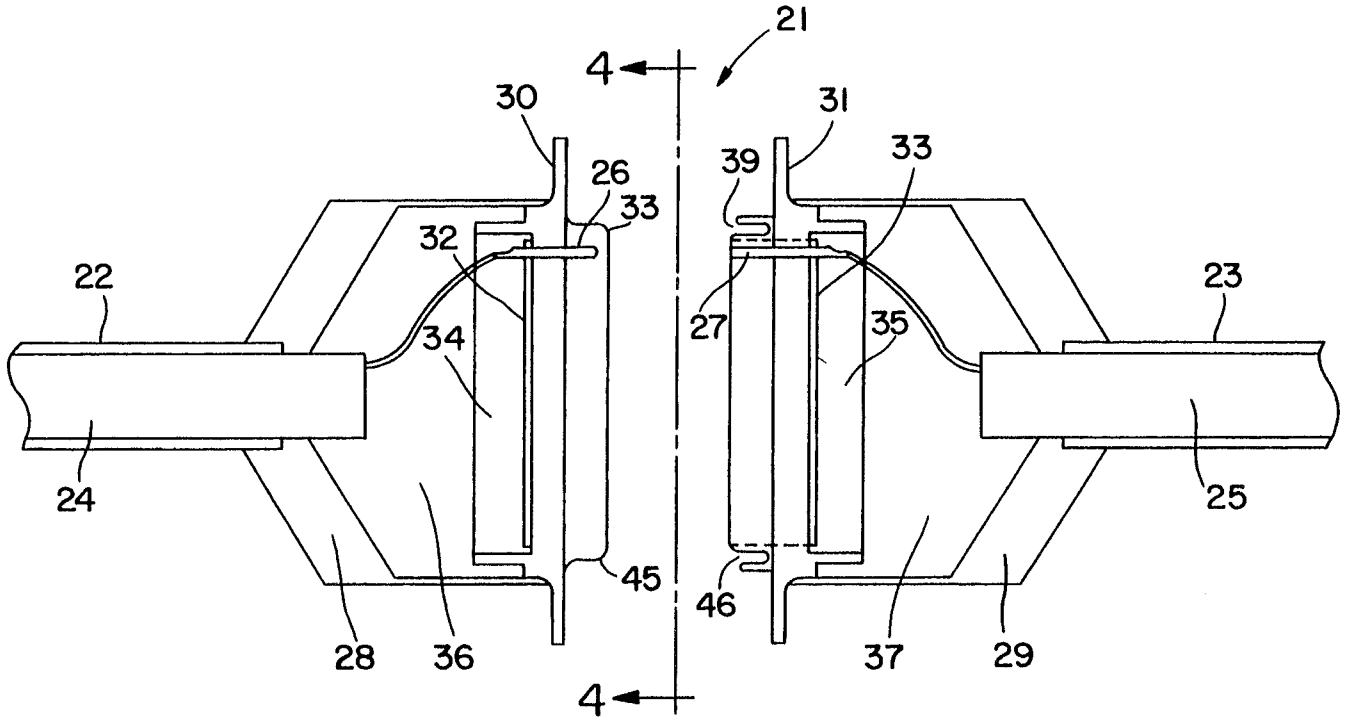
FIG. 3 is a central section, similar to that of FIG. 1, of an electrical connector having a rectangular configuration.

Referring now to FIGS. 3 and 4, therein is shown an electrical connector having a rectangular configuration. As in the case of FIGS. 1 and 2, the purpose of the electrical connector 21 therein shown is to connect one length of cable 22 to another length of cable 23. Each length of cable includes a plurality of central conductors surrounded by a copper braided shield 24, 25. The central conductors of one length of cable 22 are connected to a corresponding plurality of pins 26, and the central conductors of the other length of cable 23 are connected to a corresponding plurality of sockets 27. An outer housing 28,29 of molding compound is supported upon the termination of each cable. An EMI/RFI adapter ring 30,31 is supported inside the outer housing so as to form a cavity at the termination of each cable. The pins are supported within one connector insert 32, and the sockets are created inside another connector insert 33, the connector inserts being supported within the respective adapter rings. An inner disk 34, 35 of molding compound is supported within each half of the adapter ring so as to form, with the outer housing of molding compound, a mold. As a final step in the construction of the connector, the two molds are filled with a directly molded conductive connection 36,37, respiectively, made in accordance with the aforementioned U.S. Patent, so as to provide an electrical connection between the copper braided shield and the adapter ring and so as to provide a potting well which provides a strain relief to secure the electrical wires of the cable.

The adapter ring includes a rectangular projection 38 on one half 31 thereof and a rectangular cavity 39 on the other half 30 thereof. The geometry of the projection 38 corresponds to that of the cavity 39, and in the embodiment of the type shown in FIGS. 3 and 4 it may be rectangular with one or two sloping edges, with the result that as the connector is pushed together a tight fit results. In the embodiment shown in FIGS. 3 and 4 there is one sloping edge; thus, the sloping edge 45 on the projection 38 presses against the sloping edge 46 in the cavity 39 as the connector is pushed together. Alternatively, or in addition, a spring may be provide on one or both edges.

The outer housing of the rectangular embodiment as shown has no coupling mechanism.

Figure 6:
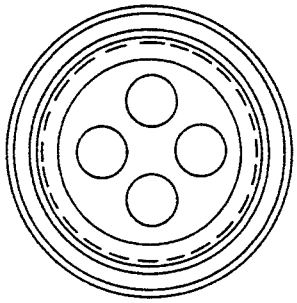
FIG. 6 is a side view along the line 6—6 of FIG. 5.
Figure 5:
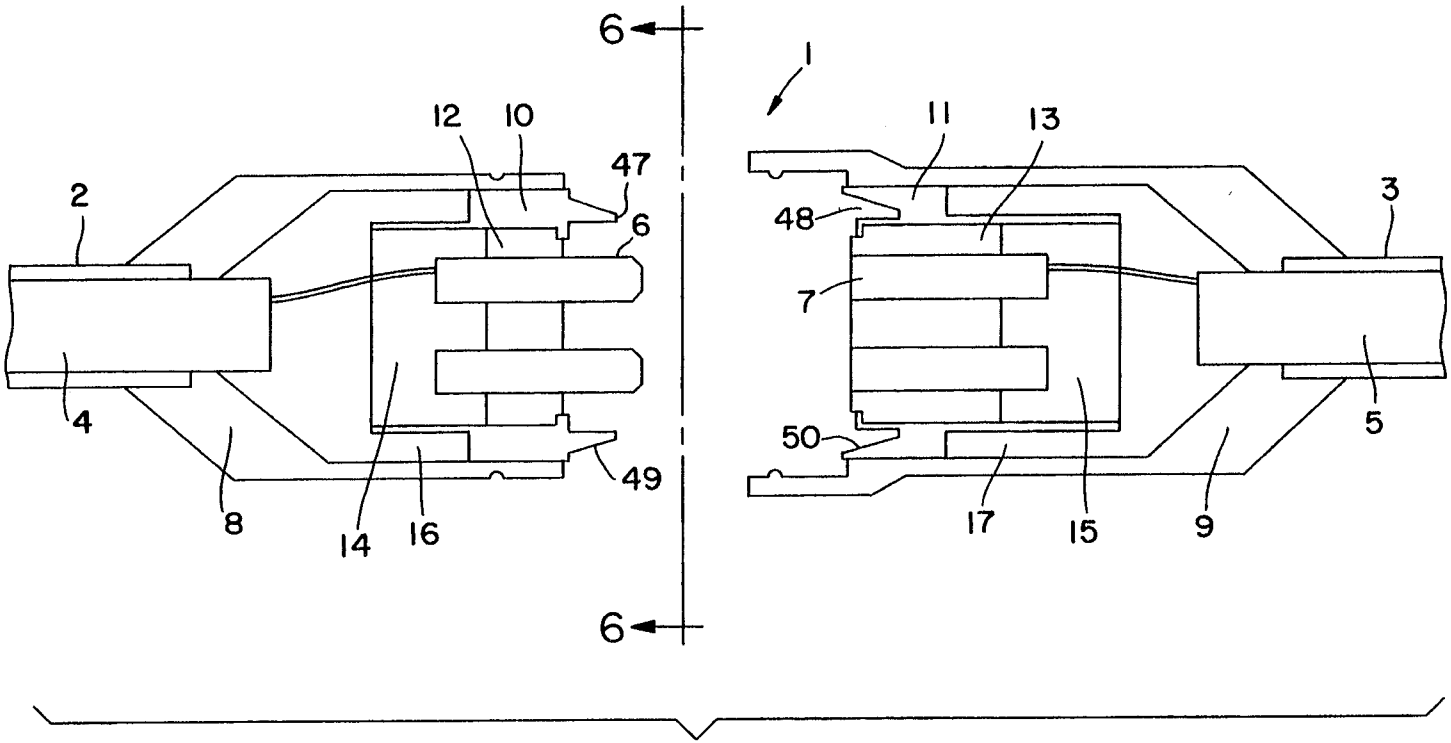
FIG. 5 is a central section, similar to that of FIG. 1, of an electrical connector having a circular quick-disconnect configuration.

Referring now to FIGS. 5 and 6, therein is shown an electrical connector having a circular quick-disconnect configuration. As in the case of FIGS. 1 and 2, the purpose of the electrical connector 1 therein shown is to connect one length of cable 2 to another length of cable 3. Each length of cable includes a plurality of central conductors surrounded by a copper braided shield 4, 5. The central conductors of one length of cable 2 are connected to a corresponding plurality of pins 6, and the central conductors of the other length of cable 3 are connected to a correponding plurality of sockets 7. An outer housing 8,9 of molding compound is supported upon the termination of each cable. An EMI/RFI adapter ring 10,11 is supported inside the outer housing so as to form a cavity at the termination of each cable. The pins are supported within one connector insert 12, and the sockets are created inside another connector insert 13, the connector inserts being supported within the adapter ring. An inner disk 14, 15 of molding compound is supported within each half of the adapter ring so as to form, with the outer housing of molding compound, a mold. As a final step in the construction of the connector, the two molds are filled with a directly molded conductive connection 16 made in accordance with the aforementioned U.S. Patent, so as to provide an electrical connection between the copper braided shield and the adapter ring and so as to provide a potting well which provides a strain relief to secure the electrical wires of the cable.

The adapter ring includes an annular projection 47 on one half 10 thereof and an annular cavity 48 on the other half 11 thereof. The geometry of the projection corresponds to that of the cavity, and in the embodiment of the type shown in FIGS. 5 and 6 it may be annular with one or two sloping edges, with the result that as the connector is pushed together a tight fit results. In the embodiment shown in FIGS. 5 and 6 there is one sloping edge; thus, the sloping edge 49 on the projection 47 presses against the sloping edge 50 in the cavity 48 as the connector is pushed together. Alternatively, or in addition, a spring may be provide on one or both edges.

The outer housing of the quick disconnect embodiment has no coupling mechanism. However, the outer housing thereof may be designed in such a way as to have a resilient, readily disconnectable arrangement comprising an annular ridge on one half and an annular groove in the other.

In some applications, the directly molded conductive connection as shown at 16,17 in FIGS. 1 and 2 may be omitted, and the copper braided shield 24,25 may be connected directly to the adapter ring 10,11. A similar variation may be made in the embodiment of FIGS. 3 and 4 and in the embodiment of FIGS. 5 and 6.

Having thus described the principles of the invention, together with several illustrative embodiments thereof, it is to be understood that although specific terms are employed, they are used in a generic and descriptive sense and not for purposes of limitation, the scope of the invention being set forth in the following claims.

I claim:

1. A cable connector for connecting two lengths of shielded cable each terminating in a plurality of central conductors surrounded by an outer electrically conductive shield (24,25) which terminates in an outer electrically conductive housing (28,29), said cable connector comprising an EMI/RFI adapter-ring pair including two members (30,31) each of which is supported inside, but separate from, its respective outer housing so as to form a cavity within which a connector insert (32,33) adapted to support pins 26 or sockets (27), respectively, is supported, and each of which member (30,31) surrounds the terminations of the plurality of central conductors within one of the cables to be connected and which is in electrical contact with the outer shield (24,25) of the cable throughout its periphery, one member of the adapter-ring pair having an annular projection (38) and the other member having an annular cavity (39) or groove adapted to coact with said annular projection, so that a tight fit results when the connector is pushed together.

2. A cable connector in accordance with claim 1, wherein said annular projection (38) has at least one sloping edge and wherein said annular groove (39) has at least one sloping edge, said sloping edges coacting to assist in providing said tight fit.

3. A cable connector in accordance with claim 1, wherein each length of cable terminates in a mold including said outer housing (28,29) and a disc insert (34,35), each member (30,31) of said adapter-ring pair being mounted between said outer housing (28,29) and said disc insert (34,35) so as to form a potting well.

4. A rectangular EMI/RFI adapter ring for connecting a length of shielded cable to an existing shielded cable, each said cable terminating in a plurality of central conductors surrounded by an outer electrically conductive shield (24,25) which terminates in an outer electrically conductive housing (28,29), said existing shielded cable including a EMI/RFI member (30) having a substantially rectangular annular projection (38), said adapter ring including a EMI/RFI member (31) which is supported inside, but separate from, its outer housing so as to form a cavity within which a connector insert (33) adapted to support pins (26) or sockets (27) is supported, and said member (31) surrounding the termination of the plurality of central conductors within its cable and being in electrical contact with the outer shield (25) of the cable throughout its periphery, said member (31) having a substantially rectangular annular cavity (39) or groove adapted to coact with said annular projection (38), so that a tight fit results when the connector is pushed together.

* * * * *